US006895610B2

(12) United States Patent
Olson

(10) Patent No.: US 6,895,610 B2
(45) Date of Patent: May 24, 2005

(54) PORTABLE BATHTUB WATER-LEVEL CONTROL DEVICE

(76) Inventor: Richard C. Olson, 28965 Lemon Rd., Mundelein, IL (US) 60060

( * ) Notice: Subject to any disclaimer, the term of this patent is extended or adjusted under 35 U.S.C. 154(b) by 0 days.

(21) Appl. No.: 10/394,538

(22) Filed: Mar. 21, 2003

(65) Prior Publication Data

US 2003/0196261 A1 Oct. 23, 2003

Related U.S. Application Data

(60) Provisional application No. 60/365,786, filed on Mar. 21, 2002.

(51) Int. Cl.[7] ..... E03C 1/00

(52) U.S. Cl. ..... 4/671; 4/694; 4/674; 4/695

(58) Field of Search ..... 4/671, 674, 679, 4/680, 508, 358, 383, 398, 694, 695, 653; 137/428, 429, 433, 101.27; 141/311 A

(56) References Cited

U.S. PATENT DOCUMENTS

| | | | | | |
|---|---|---|---|---|---|
| 865,300 | A | * | 9/1907 | Glidden | 4/346 |
| 1,262,545 | A | * | 4/1918 | Mueller | 4/694 |
| 1,353,313 | A | * | 9/1920 | Hermann | 4/694 |
| 1,598,162 | A | * | 8/1926 | Solomon | 4/694 |
| 2,398,921 | A | * | 4/1946 | Cook | 4/694 |
| 2,767,732 | A | * | 10/1956 | Hodgson et al. | 137/428 |
| 3,221,347 | A | | 12/1965 | Emery | |
| 3,497,878 | A | * | 3/1970 | Emery | 4/694 |
| 3,570,020 | A | | 3/1971 | Kato | |
| 3,859,676 | A | | 1/1975 | Kato | |
| 3,927,428 | A | * | 12/1975 | Jette et al. | 4/694 |
| 4,194,251 | A | * | 3/1980 | Pennerstorfer | 4/679 |
| 4,499,615 | A | * | 2/1985 | Radovsky | 4/366 |
| 5,025,509 | A | | 6/1991 | Holt et al. | |
| 6,008,728 | A | * | 12/1999 | Wesey | 340/618 |
| 6,216,288 | B1 | | 4/2001 | Bernau | |
| 6,480,113 | B1 | * | 11/2002 | Esposito | 340/624 |

FOREIGN PATENT DOCUMENTS

DE 4226685 A1 * 2/1994

* cited by examiner

*Primary Examiner*—Gregory L. Huson
*Assistant Examiner*—Khoa D. Huynh
(74) *Attorney, Agent, or Firm*—Fitch, Even, Tabin & Flannery

(57) ABSTRACT

An overflow protected portable bathtub water level control device comprising a main housing having two separate cavities, a flexible suction gasket, an internal float and valve mechanism with an optional temperature gauge for providing a bathtub bather with deeper bathing water.

6 Claims, 2 Drawing Sheets

PORTABLE BATHTUB WATER-LEVEL CONTROL DEVICE

This application claims the benefit of U.S. Provisional Patent Application No. 60/365,786, filed Mar. 21, 2002.

This invention relates to a personal, portable bathtub water-level control device that can retain the water level of a bathing tub at a deeper than overflow depth with safety feature's that insure overflow protection.

BACKGROUND OF THE INVENTION

A bathtub under normal fill conditions will fill to the tub's protective overflow drain level preventing a bathtub from overflowing. When a bather completely enters a full tub and situates into the lay down position his or her body displaces an appropriate volume of water sending the displaced water upwards towards the upper edge of the tub and fully over and into the protective overflow drain. It is at this time that the tub is temporarily at its deepest level and the user is in their most comfortable bathing position. As the user becomes comfortable in this above overflow depth of water, the overflow is draining the water as fast as it can. As the water drains, the user's body is becoming more and more exposed to the uncomfortably cool air. The water then seeks a level balanced to the tub's low-level overflow design and leaves the user partially in bathing water and partially out. This position leaves the bather partially exposed, wet, cold and uncomfortable.

SUMMARY OF THE INVENTION

In view of the foregoing, the main objective of this Invention is to supply the user with a portable device that will safely sustain a bathtub's water level at a depth above the overflow low-level water line of that tub, therefore, giving the bather deeper bath water for a more comforting bathing experience.

The portable bathtub water-level control device allows the user to fill a tub normally and unattended to it's safest water level overflow height. The device portably attaches to the smooth surfaced tub over the tub's existing overflow by use of a semi-continuous flexible suction gasket. This device is made primarily of plastic, which creates a long lasting water impervious product. It is designed to allow the filling tub water to run safely through the device to the overflow drain while filling unattended and fill only to the tub's low level overflow design. When the user enters the tub, the sudden rise in water level raises an internal float inside the device that closes a valve stopping water to the overflow. After the valve closes, any water that continues to rise above the device is allowed to spill over and into the open top and disperse freely into the existing overflow drain. This excess overflowing water will stop when the water level is at the safe high height established by the device and will then supply the user with a sustained long lasting deep-water bath. Any additional water added later by the bather will enter the existing tub water and then simply run over the top of the device and into the overflow below. This enables the user to add hot or cold water to change the water temperature of the bath without affecting the tub's water depth.

Because the device's valve is activated by a sudden change in water depth and "only" after the water has reached full level contact with the device, the user if entering the tub prior to this depth may find it necessary to activate the internal valve manually. For this the device is equipped with a "toe" operated button that holds the valve in its closed position until the water level rises high enough that the device's internal float is activated and will hold the valve closed. Once closed, the user is free to bath continuously in the deeper than normal water.

This device consists of: a molded plastic main housing having a perimeter inserted flexible plastic suction seal, an internal valve and float mechanized assembly, a "toe" operated button linked to the valve-float assembly and a snap-in name plate or an optional digital temperature gauge.

Accordingly, the main object of the invention is to supply the public with a new and improved portable device that will allow them to experience a deep water bath in a conventional bathtub without going beyond the design limits of this conventional everyday use bathtub.

BRIEF DESCRIPTION OF THE DRAWINGS

FIG. 8 is a perspective view of a float; and

FIG. 9 is a perspective view of connector rods from the float to a valve member.

DETAILED DESCRIPTION OF THE PREFERRED EMBODIMENT

Figure 1:
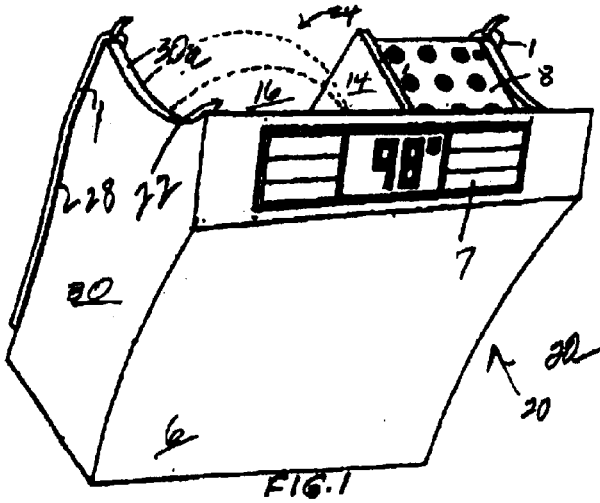
FIG. 1 is a perspective view showing the main housing with the optional temperature gauge, the flexible suction gasket with its release tabs, the drain-vent cover for the displaced water and the main housing divider wall.
Figure 2:
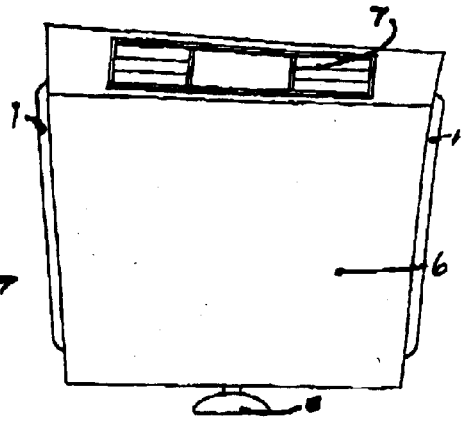
FIG. 2 is a front view showing the main housing, the flexible suction gasket, the optional temperature gauge and the "toe" operated valve button.
Figure 3:
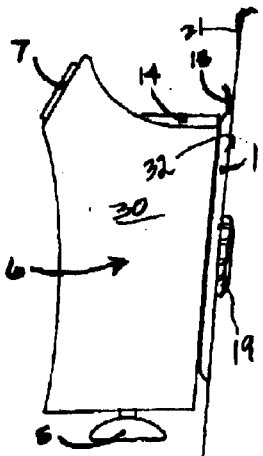
FIG. 3 is a right side view showing the main housing, the suction gasket with their release tabs, the top of the divider wall, the side of the optional temperate gauge and the "toe" operated valve button.
Figure 4:
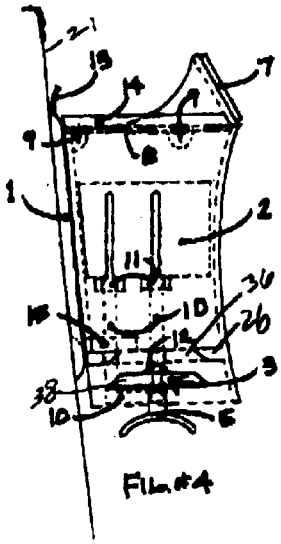
FIG. 4 is a section view through the left side showing the suction gasket, the float and valve assembly in the displacement water cavity, the drain and vent cover in the displacement water cavity, the valve and "toe" operated button in the overflow cavity.

In operation of normal design use, the user after referring to the supplied directions would first close their tubs factory built-in drain 19. Then by hand fasten the portable water level control device 20 by simply placing it into position over the tub's overflow drain 19 and then pressing it tightly against the tub vertical wall surface 21 until its suction cup perimeter band gasket 1 is securely fastened. The user may then fill the tub unattended. As the tub fills, the user is optioned to wait for the tub to fill to its highest controlled level before entering, or may enter the tub prior to it filling completely. If the user has chosen to wait for the tub to fill completely they may enter the tub at this full-filled level, upon entering the water displaced by the user rises up onto or over the device and may drain into the device until the water levels out at the device's top. At this level, the water will be sustained, this depth is the same depth the water would have temporarily risen to if the suer had entered the same tub without the device in place. This establishes the device's safety credibility by not exceeding any limit's of the tub's original design.

If the user has chosen to enter the tub while it is filling, the user may find it necessary to use the "toe" operated button 5 to temporarily close the internal valve 3. In the lay down position while the tub is still filling, the user would use their toe to lightly press the button 5 on the bottom of the device which will close the valve 3 allowing the water to fill to the top of the device. After the water has filled the tub, the valve 3 will stay closed without pressing the button 5 allowing the user the freedom to bath comfortably.

When the user has finished bathing, they would simply drain the tub as usual and the device will reset itself for the next time.

Figure 6:
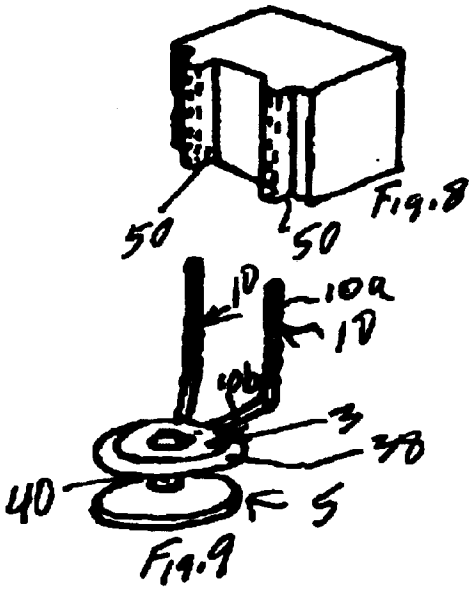
FIG. 6 is an exploded view of the housing, gasket and overflow cover plate.
Figure 6:
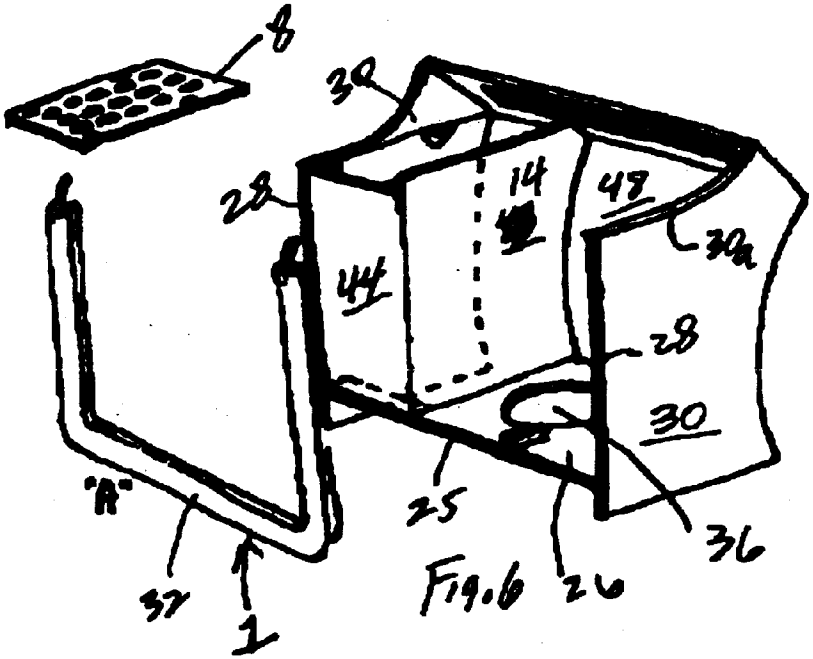
Figure 7:
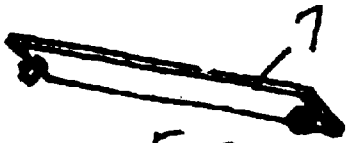
FIG. 7 is a perspective view of a name plate.

The plastic housing 6 (FIG. 6) has an open top 22 and open back 24 which is defined by an edge 25 on a bottom horizontal wall 26 and vertical edges 28 of a pair of spaced vertical housing side walls 30. A U-shaped gasket 1 is secured to the edges 25 and 28 of the housing side walls and has a suction cup-shaped surface 32 which adheres to the tub's vertical wall 21 at the location of the tub drain 19 and forms a seal with the tub wall thereby effectively sealing off the tub drain to water inflow from outside of the housing 6.

The interior of the housing 6 has a main overflow cavity or chamber 16 into which water flows when the height of the water in the tub is sufficiently high to flow over upper edges 30*a* of the sidewalls 30. Water may also flow into the bottom of the overflow chamber 16 through a circular valve orifice or hole 36 when the valve 3 is in the lowered open position. The valve 3 has a circular valve member 38 with a beveled edge 38*a* that mates with a beveled seat or edge 36*a* about the valve orifice 36 in the bottom housing wall 26.

Figure 5:
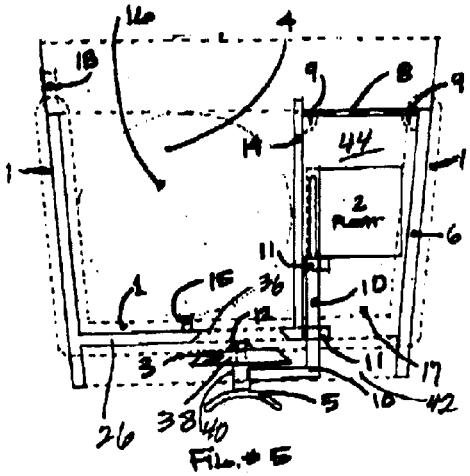
FIG. 5 is a section view through the front showing the two main cavities. The overflow cavity takes all excess water and all water flowing prior to the user's entry. The displacement cavity activates only with action by the user either by full tub entry displacing the water, which raises the float closing the valve, or by use of the "toe" operated button. The water is displaced up and through the displacement cavity and out through the drain and vent cover. The tub's overflow cover is shown faintly in the background with the device placed up and against the built-in alignment stop.

For the purpose of manually closing the valve 3 to inflow of water through the valve orifice 36, a curved "toe" operator 5 is fixed to a depending stem 40 on the valve 3; and by the bather pushing up with a toe, the valve member 3 may be seated to seal the orifice 36. Water may still flow through the open bottom 42 of a float chamber 44 which is defined by a vertical back wall 46 (FIG. 6) and a vertical interior divider wall 14 extending from the back wall to housing front wall 48. A float valve 2 having a hollow float body 2*a* (FIG. 8) is positioned in the float chamber to rise and lower with the level of tub water in the tub. Water enters the float chamber 44 through the open bottom 42 of the float chamber. The float has a pair of vertical ribs 50 that have bores therein to receive a pair of vertical guide rods 10 (FIGS. 5 and 9). The guide rods 10 have lower portions 10*a* extending horizontally to vertical upper portions 10*b*. The lower portions 10*a* have ends that are secured to the valve 3. Thus, as the float 2 rises and falls, the valve 3 is raised or lowered between its upper closed position and its lower open position, unless the bather lifts the valve 3 with his toe and thereby also lifts the float and overrides the float operation.

If the bather does lift the valve 3 to the close position, then water rises in the float chamber 44 and lifts the valve to close the valve when the upper end of the float is adjacent a top drain and vent cover 8 (FIG. 6) which is a flat horizontal apertured plate located at the top of the float chamber. Water flowing over the upper edges 30*a* of the housing sidewalls flows through the drain vent cover 8 to fill the float chamber 44 completely. Simultaneously, water overflowing the upper edges 30*a* of the housing walls 30 will raise the overflow cavity to the height of the tub drain 34 because the valve 3 is closed. With the valve 3 closed, water will rise in the float chamber and pass through the apertures 8 in the drain plate and will rise to flow across the housing side wall edges 31*a* into the overflow chamber 44 and then flow out the tube drain 19. Because the sidewall top edges 30*a* are above the drain 19, the water level in the tub will also be at a level higher than the drain 19.

What is claimed is:

1. A portable water level control in combination with an overflow drain located on a bathtub wall, said device positioning over the overflow drain on the bathtub wall and comprising:

a housing;

a float chamber in the housing;

a float mounted in the housing float chamber to rise and fall therein with a rising and lowering level of water in the float chamber;

an overflow chamber in the housing having an opening allowing water to flow from the overflow chamber to the overflow drain of the bathtub; and an inlet valve for the overflow chamber operated by the float to close or open the inlet valve to control water flow through the valve into the overflow chamber.

2. A device in accordance with claim 1 comprising:

a gasket to seal the housing to the bathtub wall.

3. A device in accordance with claim 2 wherein the gasket has a suction cup shape to hold the device on the bathtub wall.

4. A device in accordance with claim 3 wherein portions of the gasket are to be grasped and pulled to break the suction seal to the bathtub to allow removal of the device from the bathtub.

5. A device in accordance with claim 1 comprising:

an inlet valve orifice in the bottom of the overflow chamber;

a valve member to be seated against the valve orifice to close the valve and to be spaced therefrom when the valve is open; and a toe operator to shift the valve member to close water inflow through the valve orifice into the overflow chamber.

6. A device in accordance with claim 5 comprising:

a connector extending from the float in the float chamber to the valve for the overflow chamber.

* * * * *

UNITED STATES PATENT AND TRADEMARK OFFICE

CERTIFICATE OF CORRECTION

PATENT NO. : 6,895,610 B2
DATED : May 24, 2005
INVENTOR(S) : Richard C. Olson

It is certified that error appears in the above-identified patent and that said Letters Patent is hereby corrected as shown below:

Column 4,
Line 19, after "control" insert -- device --.

Signed and Sealed this

Thirteenth Day of September, 2005

JON W. DUDAS
*Director of the United States Patent and Trademark Office*